US005484176A

United States Patent [19]

Sallwasser

[11] Patent Number: 5,484,176

[45] Date of Patent: Jan. 16, 1996

[54] LATCH MECHANISM

[75] Inventor: Alan J. Sallwasser, Chatenay Malabry, France

[73] Assignee: Motus, Inc., Indianapolis, Ind.

[21] Appl. No.: 245,602

[22] Filed: May 20, 1994

[51] Int. Cl.[6] ..... E05C 1/02

[52] U.S. Cl. ..... 292/137; 292/145; 292/201

[58] Field of Search ..... 292/137, 145, 292/153, 146, 341.16, 341.17, 201; 49/379

[56] References Cited

U.S. PATENT DOCUMENTS

| | | | |
|---|---|---|---|
| 832,284 | 10/1906 | White . | |
| 848,515 | 3/1907 | Tysinger . | |
| 1,986,677 | 1/1935 | Johnson | 292/278 |
| 2,097,197 | 10/1937 | Lessier | 95/40 |
| 3,522,963 | 8/1970 | Farnden | 292/83 |
| 3,722,927 | 3/1973 | Miska | 292/128 X |
| 3,725,972 | 4/1973 | McCabe | 16/48.5 |
| 3,848,907 | 11/1974 | Shiurila | 292/81 |
| 4,230,352 | 10/1980 | Sealey | 292/341.17 |
| 4,287,638 | 9/1981 | McCabe | 16/48.5 |
| 4,441,236 | 4/1984 | Bron | 292/201 |
| 4,506,407 | 3/1985 | Downey | 16/48.5 |
| 4,656,690 | 4/1987 | Katagiri et al. | 16/48.5 |
| 4,715,146 | 12/1987 | Atsumi et al. | 49/1 |
| 4,801,163 | 1/1989 | Miller | 292/201 |
| 5,044,680 | 9/1991 | Baker et al. | 49/379 |
| 5,072,973 | 12/1991 | Gudgel et al. | 49/379 |
| 5,085,475 | 2/1992 | Austin et al. | 292/153 |
| 5,140,173 | 8/1992 | Chau et al. | 307/125 |
| 5,234,238 | 8/1993 | Takimoto | 292/DIG. 43 |

*Primary Examiner*—Peter M. Cuomo
*Assistant Examiner*—Monica E. Millner
*Attorney, Agent, or Firm*—Ice Miller Donadio & Ryan; Paul B. Overhauser; Doreen J. Gridley

[57] ABSTRACT

A latch mechanism includes a first latch member, a second latch member and a ramp mechanism. A first latch element of the first latch member is cooperatively structured with a second latch element of the second latch member to be engageable therewith. The first and second latch members are latched together when the second latch member is disposed in the latching position and the first latch element engages the second latch element. When at least one of the latch members is moved in a first direction to an unlatching position while the first and second latch elements are engaged, the ramp mechanism causes either the first latch member or the second latch member to be displaced in a second direction relative to the other latch member, whereby the first latch element and the second latch element disengage to unlatch the first and second latch members.

22 Claims, 5 Drawing Sheets

LATCH MECHANISM

BACKGROUND OF THE INVENTION

This invention relates to a mechanism for latching together two objects, and, in particular, to a latch mechanism which can be mechanically unlatched either manually or automatically.

Latch mechanisms are employed in a wide range of products and provide a function of releasably holding or latching together two objects. For example, U.S. Pat. Nos. 3,848,907, 848,515, and 832,284 disclose different types of latch mechanisms employing resilient or leaf spring components. While perhaps useful to latch two objects together, these mechanisms are not particularly designed to unlatch when sufficient manual force is exerted to pull the latched objects apart, which is a desirable feature of a latch mechanism for use in some operations. In other devices such as that disclosed in U.S. Pat. No. 3,522,963, while manual unlatching of the latch mechanism is possible, the device does not adequately provide for an automatic unlatching or release of the latched component.

One well known type of product which includes a latch mechanism are hold open devices which may be utilized to maintain a door or other object in a selected position until a certain event occurs. Because in places such as hospitals many doors are desired to be kept open to allow easy passage therethrough, and because these doors are to automatically close during fires, door hold open devices are employed. A door is coupled by means of a rod to a portion of the latch mechanism of the door hold open device, and the latch mechanism is then latched, thereby maintaining the door in an open position. Upon a signal that smoke is present, the latch mechanism is automatically released, allowing the door to be biased closed to thereby contain the smoke and fire. Alternatively, hold open devices can be used as executive door releases. For instance, if an executive engages the latch mechanism and has a door propped open during a conversation with a client and realizes important matters are to be discussed, the latch mechanism of the door release can be remotely activated and thereby unlatched to allow the door to close automatically without the executive leaving his or her seat.

An existing problem with latch mechanisms such as those used in many door hold open devices results from the need to unlatch the latch mechanism both automatically and manually. While automatic unlatching upon a given condition may be the preferred mode of unlatching, it is often necessary to manually unlatch and then relatch the latch mechanism. For instance, and again considering door hold open devices used in hospitals, doors being held open must occasionally be closed to allow proper cleaning to be performed. Due to the configuration of some latch mechanisms, such as that disclosed in U.S. Pat. No. 5,140,173, the manual unlatching, and the subsequent relatching of the door hold open device to return the held door to the propped open position, may require an appreciable amount of force to be exerted or may possibly fatigue and wear away the latch mechanism. Thus, it is desirable to provide a latch mechanism which can be manually unlatched and relatched with a minimum of physical strength and effort, as well as be readily unlatched automatically if such an unlatching feature of the latching mechanism is desired.

SUMMARY OF THE INVENTION

In one form thereof, the latch mechanism of the present invention includes a first latch member, a second latch member, and a ramp means. The first latch member includes a first latch element. The second latch member includes a second latch element. The second latch member is movable in a first direction from a latching position to an unlatching position. The second latch element is cooperatively structured with the first latch element to be engageable therewith. The first and second latch members are latched together when the second latch member is disposed in the latching position and the first latch element engages the second latch element. The ramp means are for moving at least one of the first latch member and the second latch member in a second direction relative to the other of the first latch member and the second latch member when the second latch member moves in the first direction to the unlatching position while the first and second latch elements are engaged, whereby the first latch element and the second latch element disengage to unlatch the first and second latch members.

In another form thereof, the latch mechanism of the present invention includes a latchable member, a latching member, and at least one ramp member. The latchable member includes a latchable element projecting therefrom. The latching member, which includes a latching element, is movable from a latching position toward an unlatching position. The latching element is cooperatively structured with the latchable element to achieve a latching engagement therewith when the latching member is disposed in the latching position and the latching element engages the latchable element. The at least one ramp member is structured and arranged to direct the latching element out of the latching engagement with the latchable element when the latching member is moved from the latching position toward the unlatching position.

In another form thereof, the latch mechanism of the present invention is for releasably coupling a first object and a second object and comprises a latchable component connected to the first object and a latching component connected to the second object. The latchable component includes a projection extending in a first direction. The latching component includes a latching member having a forward end and a projection receiving element formed therein. The latching member is slidable in a second direction from a latching position to an unlatching position. The projection receiving element is cooperatively structured with the projection to be engageable therewith. The latching component and the latchable component are latched together when the latching member is disposed in the latching position and the projection and the projection receiving element are engaged. The latch mechanism also comprises a ramp means for contacting the forward end of the latching member when the latching member slides in the second direction from the latching position to the unlatching position. The ramp means is structured to move the latching member in the first direction such that the projection disengages from the projection receiving element, whereby the latchable component and the latching component are unlatched.

In still another form thereof, the latch mechanism of the present invention comprises a first latch member, which includes a projection extending therefrom, and a second latch member, which includes a projection receiving element. The first latch member is longitudinally movable between a latched position, wherein the projection and the projection receiving element are latchingly engaged, and an unlatched position. The latch mechanism also comprises ramp means for directing the projection receiving element in an angular direction relative to the direction of movement of the first latch member upon movement of the first latch member from the latched position toward the unlatched position. The ramp means are configured to displace the projection receiving element a distance sufficient to disengage the projection and projection receiving element upon the movement of the first latch member, thereby unlatching the first and second latch members.

An advantage of the present invention is that the latch mechanism can be unlatched in two manners or methods of mechanical motion. Another advantage of the present invention is that manual unlatching and latching of the latch mechanism requires little concentration or physical effort. Another advantage of the present invention is that the uncomplicated design and interconnection of the parts which preferably automatically unlatch the latch mechanism simplifies latch mechanism production. Other advantages of the present invention will become apparent from the following description.

BRIEF DESCRIPTION OF THE DRAWINGS

Corresponding reference characters indicate corresponding parts throughout the several Figures.

DETAILED DESCRIPTION

Figure 1:
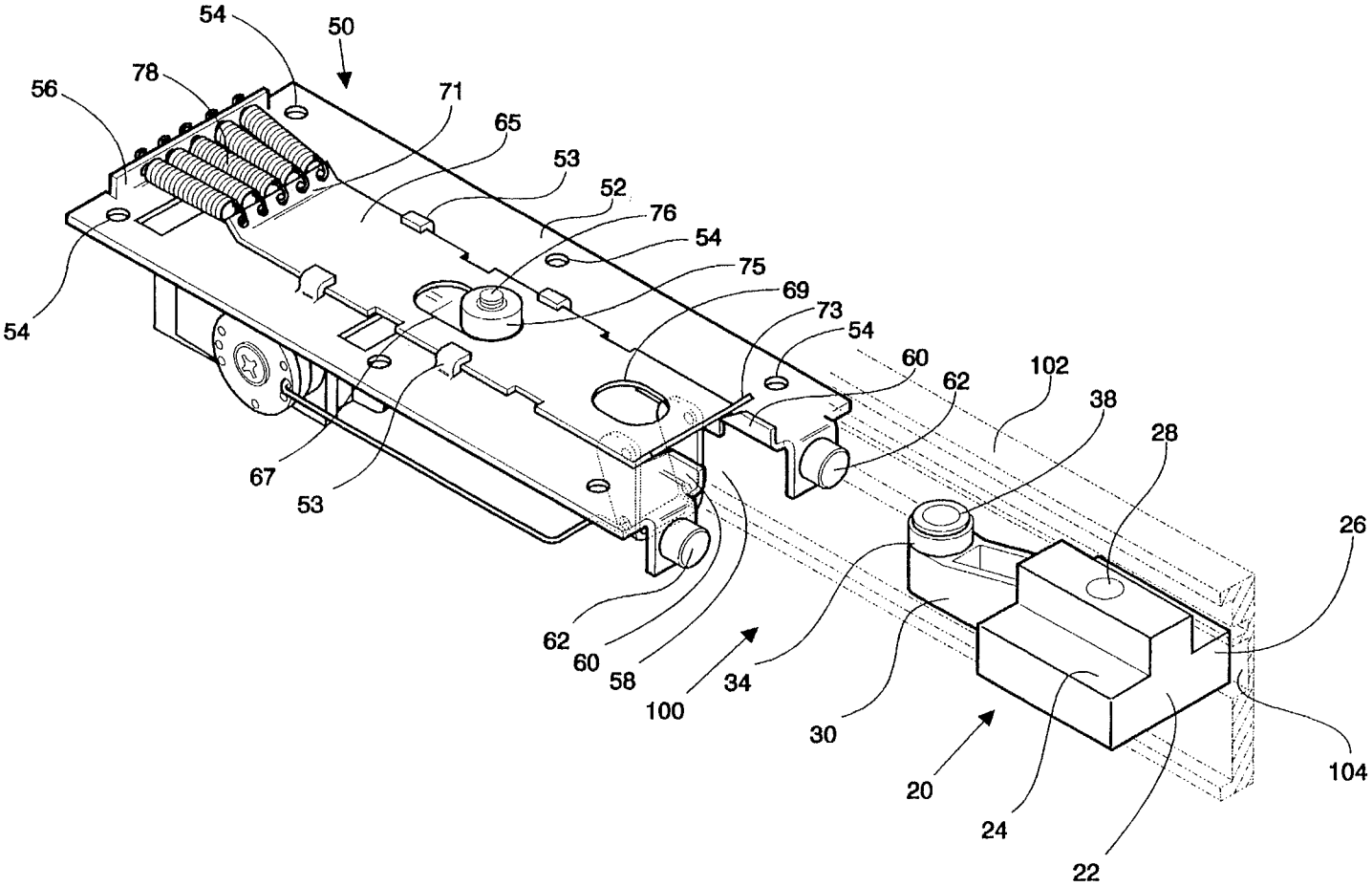
FIG. 1 shows a perspective view of one embodiment of the latch mechanism of the present invention, wherein the latchable component and the latching component are in an unlatched condition and in a spaced apart relationship.
Figure 2:
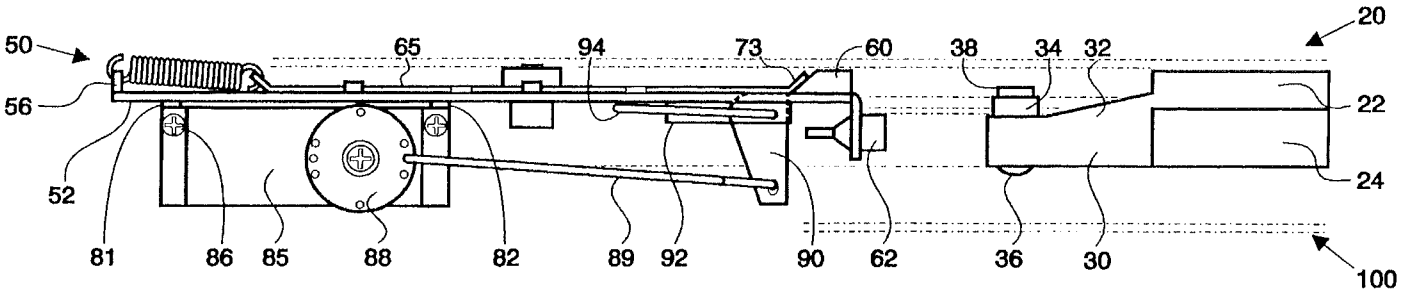
FIG. 2 shows a side view of the latch mechanism of FIG. 1.

Referring now to FIGS. 1 and 2, there is illustrated an embodiment of the latch mechanism of the present invention. Shown being used in conjunction with a track, which is generally designated 100 and shown in shadow, the latch mechanism includes a latchable component, generally designated 20, and a latching component, generally designated 50. Only one side, or the right side in FIG. 1, of the track is shown in FIGS. 1 and 2, as the mirror image portion of track 100 which guides the left side of the latch mechanism is removed for illustration purposes. Both sides of track 100 are shown in shadow in FIG. 3. Track 100 includes an elongated housing 102 with internal, longitudinal passageways 104 which guide the relative movements of the latch mechanism components 20, 50.

In one embodiment, latching component 50 is riveted to housing 102 and does not generally slide relative thereto, while latchable component 20 slides along the length of passageways 104 of housing 102. This particular type of elongated track and latching mechanism finds useful application in door hold open devices, such as the device described in U.S. Pat. No. 5,140,173, the disclosure of which is explicitly incorporated herein by reference. However, although further explained herein with reference to such devices, the latching mechanism of the present invention may be advantageously applied in other fields where two objects are desired to be releasably connected together. Moreover, track 100 itself is not essential to the present invention, but merely is an example of a track that may be used with the inventive latching mechanism. In situations where the latch mechanism components need not be guided or restricted when not latched together, track 100 as shown could be eliminated. In such instances, latchable component 20 and the latching component 50 may be arranged in a mating relationship, provided such a relationship results in the proper alignment and spacing during latching of the elements of latching component 50 and latchable component 20 designed to engage and thereby latch the components together.

Latchable component 20 includes slide block 22 having opposing lateral flanges 24, 26 shaped to be slidably received within passageways 104. Consequently, passageways 104 define a linear sliding travel path of latchable component 20. Slide block 22 also includes a threaded central bore 28 which allows for connection to an object to be latched. For example, in door hold open devices, bore 28 could be connected by screw to an intermediate rod connected to a door. A longitudinally and horizontally projecting tongue 30 extends from slide block 22 and includes reinforcing ribs 32. As used throughout the specification, horizontal and vertical, as well as top, bottom, up and down, refer to the directions and orientations of the latch mechanism as shown in FIGS. 1 and 2. As the present invention functions when oriented other than as shown in the Figures, such directions and orientations are not limiting but rather are merely descriptive and provided to facilitate explanation. A cylindrical pin 34, attached to tongue 30 by means of screw 36 passing therethrough, projects upwardly from tongue 30. An annular extension 38 of pin 34 has a lesser diameter than the main body of pin 34 and projects upward from the distal end of the main body of pin 34.

Figure 3:
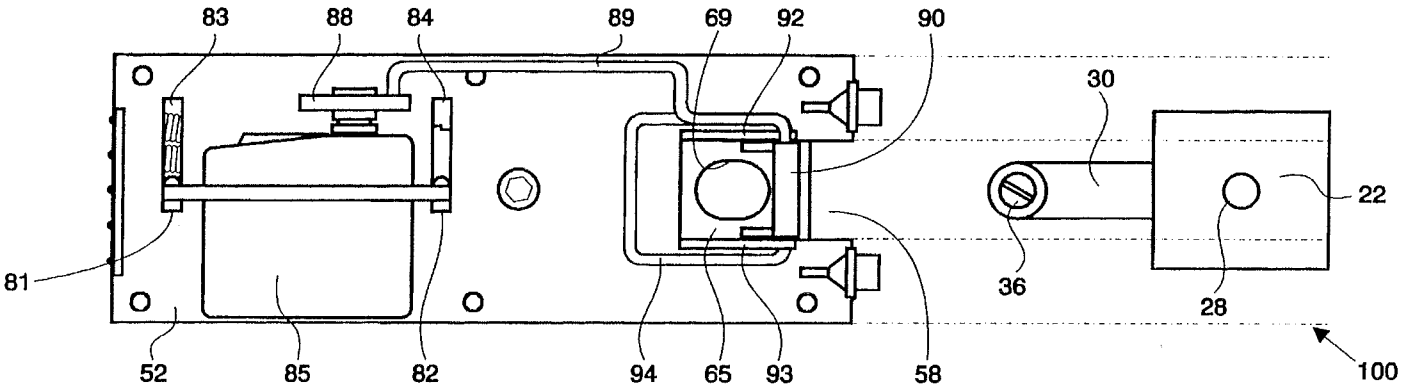
FIG. 3 shows a bottom view of the latch mechanism of FIG. 1.
Figure 4:
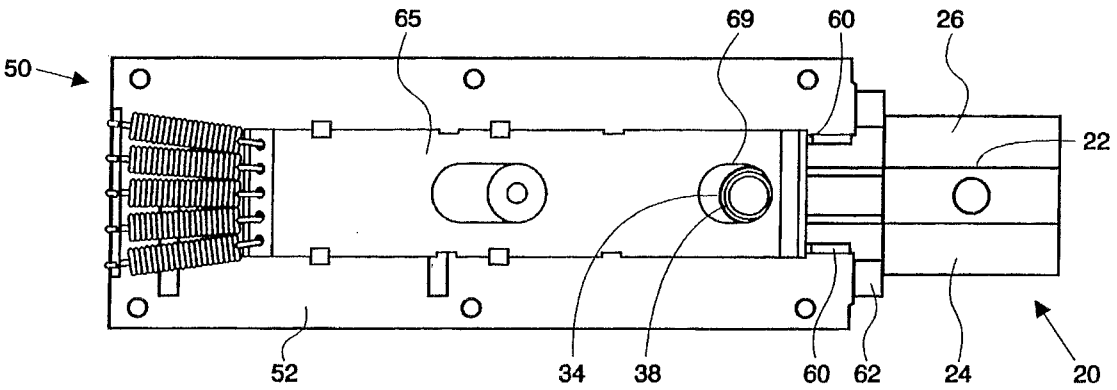
FIG. 4 shows a top view of the latching component and latchable component of the latch mechanism of FIG. 1, wherein the latch mechanism is in the latched condition.

Referring now to FIGS. 2–4, latching component 50 includes a frame plate 52, essentially rectangular in shape, having circular apertures 54 around its perimeter. Apertures 54 receive rivets (not shown) therethrough to provide a secure and non-sliding connection of frame plate 52, and thereby latching component 50 in general, to track 100. Frame plate 52 is formed with an upwardly extending flange 56 at its rearward end, i.e. the end opposite latchable component 20, a rectangular notch 58 formed in its forward end, and a pair of upwardly extending sloped or ramp shaped members 60 flanking notch 58. A pair of rubber bumpers 62 are mounted on downwardly extending flanges of frame plate 52.

Latch member 65, shaped as a substantially flat rectangular plate, is the portion of latching component 50 which physically engages latchable component 20 during latching. Latch plate 65 is slidably coupled to the top surface of frame plate 52 via lugs 53 projecting upward from and integral with frame plate 52. Lugs 53 allow latch plate 65 to longitudinally slide horizontally while substantially preventing the portion of latch plate 65 between lugs 53 from vertical movement and horizontal transverse movement.

In one embodiment, latch plate 65 is rigid in the longitudinal and horizontal direction, while still being sufficiently flexible and resilient in the vertical direction to function as a leaf spring. In particular, as functionally described more fully below, latch plate 65 can bend or deflect vertically relative to frame plate 52 against the returning force of the internal spring bias of latch plate 65. The bending of latch plate 65 naturally occurs at the point of contact with forward lugs 53. Latch plate 65 includes central aperture 67, forward latching aperture 69, upwardly angled lip 71 at the rearward end of latch plate 65, and upwardly angled lip 73 at the forward end of latch plate 65. A latch plate stop 75 in the form of a cylindrical nut is fixedly attached to frame plate 52 via bolt 76, which passes through frame plate 52 and is threadedly received by stop nut 75. Latch plate stop 75 protrudes upwardly through central aperture 67 and engages the perimeter inner surface of aperture 67 to regulate the range of longitudinal movement of latch plate 65. Tension coil springs 78, which are attached at opposite ends to upwardly angled lip 71 and upwardly extending flange 56, provide a biasing force to return latch plate 65 to its operative latching position after it is slid forward to its unlatching position during manual unlatching as described below.

Forward latching aperture 69, which is positioned above the rectangular notch 58 in frame plate 52, includes an arcuate forward end sized and shaped complementary to annular extension 38 of cylindrical pin 34. The perimeter inner surface of aperture 69 engages the upright side surface of annular extension 38 during latching. At its largest region, aperture 69 is preferably sized smaller than the diameter of the main body of projecting pin 34 such that only annular extension 38 can be inserted therein during latching.

Referring now especially to FIG. 2 and FIG. 3, the elements which provide for an automatic unlatching of the latch mechanism are illustrated. Two motor mounting flanges 81, 82 extend downwardly from frame plate 52. Flanges 81, 82 are preferably punched from frame plate 52, creating holes 83, 84, and bent downward ninety degrees. Servomotor 85, mounted to flanges 81, 82 via screws 86 or other fasteners, includes a driven disc 88 operably connected to pivoting cam 90 via actuator rod 89. Cam 90 is pivotally connected to an opposing pair of frame flanges 92, 93 by inwardly extending fingers at the forward end of substantially C-shaped axle 94. Cam 90 is disposed between frame flanges 92, 93 and directly below latch plate 65, such that when cam 90 pivots as described below its camming surface directly contacts the underside of latch plate 65.

The construction of the above described latching mechanism will be more fully understood in view of the following explanation of its operation. When the latch mechanism is not latching two objects together, latchable component 20 and latching component 50 may be located as shown in FIGS. 1–3, with springs 78 biasing latch plate 65 to a longitudinal latching position shown.

As shown in the embodiment of FIGS. 1–3, latching component 50 is fixed to track 100. As a result, in order to latch together the latch mechanism components, latchable component 20 must be slid toward latching component 50, or to the left in the Figures. As slide block 22 proceeds to slide to the left, latchable component 20 makes contact with component 50. In particular, because of the structures and relative spatial orientations of components 20, 50, the rearward end of annular extension 38 initially contacts the underside of frame plate angled lip 73. Slide block 22 is constrained in the vertical direction by the supporting force of the lower members of track passageways 104 acting on lateral flanges 24, 26, and cylindrical pin 34 is fixedly secured to slide block 22 via tongue 30. As a result, pin 34 and annular extension 38 are constrained from any appreciable vertical movement upon contact with lip 73. Consequently, as latchable component 20 and therefore annular extension 38 is manually forced further to the left, angled lip 73 and the portion of latch plate 65 forward of lugs 53 are shifted upward.

In the embodiment wherein latch plate 65 is flexible, this shifting occurs by the forward end of latch plate 65 bending upward. If a flexible latch plate were not to be employed, a rigid latch plate could be shifted upward to allow projecting pin 34 to slip thereunder, for example by way of the rigid latch plate being pivoted against frame plate 52. This type of pivoting vertical movement of latch plate 65 could be achieved by, for example, mounting lugs 53 on appropriate strength springs to allow the lugs sufficient vertical play while still functioning to guide latch plate 65.

When latchable component 20 has been sufficiently moved to the left such that annular extension 38 is positioned fully below forward latching aperture 69, the leaf spring construction of latch plate 65 causes plate 65 to snap downward to a horizontal position, capturing annular extension 38 within aperture 69. It will be appreciated that latching component 50 and latchable component 20 are thereby latched together as shown in FIG. 4, as the forward portion of the perimeter inner surface of latching aperture 69 engages the upright side surface of annular extension 38 and prevents slide block 22 from slipping back to the right. Slide block 22 is prevented from being inserted too far to the left by rubber bumpers 62, which contact slide block flanges 24, 26.

When in the latched condition, the latching mechanism of the present invention can be mechanically unlatched, whereby the latchable component 20 is released or unlatched from the latching component 50. A first unlatching method, which for door hold open devices is accomplished manually, is described with particular reference to FIG. 5. When in the latched condition as shown in FIG. 4, latch plate 65 is located in a longitudinal latching position to the left of ramp shaped members 60. During manual unlatching of the latching mechanism, a pulling force directed to the right in the Figures is applied to slide block 22. As slide block 22 is pulled to the right, the forward surface of annular extension 38 abuts the perimeter interior surface of latching aperture 69. Provided sufficient force is applied, slide block 22 continues sliding to the right, simultaneously pulling latch plate 65 to the right due to the engagement of annular extension 38 with latching aperture 69. The longitudinal sliding of latch plate 65 along the surface of frame plate 52 from its latching position occurs against the force of springs 78, which extend during this sliding motion.

It will be appreciated by those of skill in the art that the number and strength of springs employed in the latching mechanism determines the required pulling force applied to slide block 22 to manually unlatch the latch mechanism. Therefore, varying spring strengths, and/or numbers of springs may be desired for different applications of the latching mechanism of the present invention.

Figure 5:
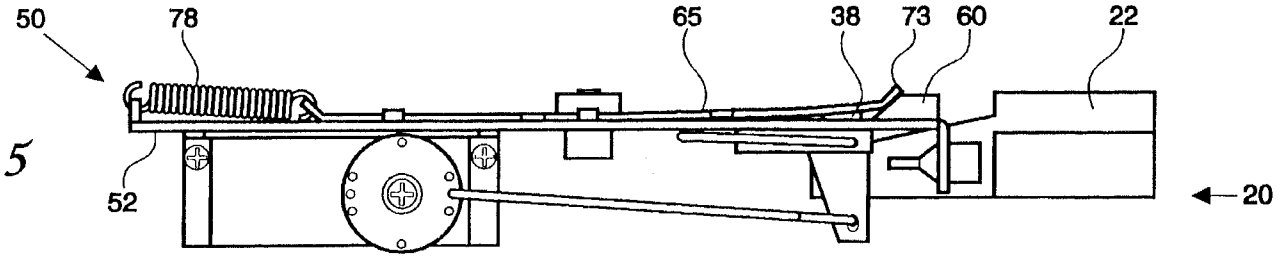
FIG. 5 shows a side view of the latch mechanism wherein the latchable component is operatively engaged or latched by the latching component, and wherein the latchable component is in the process of being manually unlatched from the latching component.

It will also be appreciated that when such a latch mechanism is employed in a door hold open device and the door is coupled to slide block 22, a small closing force applied to the edge of the held door may produce a significant pulling force on slide block 22 due to the long moment arm through which the force acts. As slide block 22 continues still further to the right, and as shown in FIG. 5, angled lip 73 contacts and begins to slide along ramp shaped members 60, and thereby shifts the forward end of latch plate 65 upward. During this shifting, the forward end of latching aperture 69 is consequently raised. When latch plate 65 is moved far enough to the right to an unlatching position, and because the elevation of annular extension 38 is fixed as described above, latching aperture 69 shifts upward out of contact and thereby disengages annular extension 38. Latchable component 20 is then free to move along track 100 to the right. As a result of annular extension 38 being released, latch plate 65 is no longer being pulled to the right and the extended coil springs 78 return latch plate 65 from the unlatching position to which it has been pulled to its ready latching position.

Figure 6:
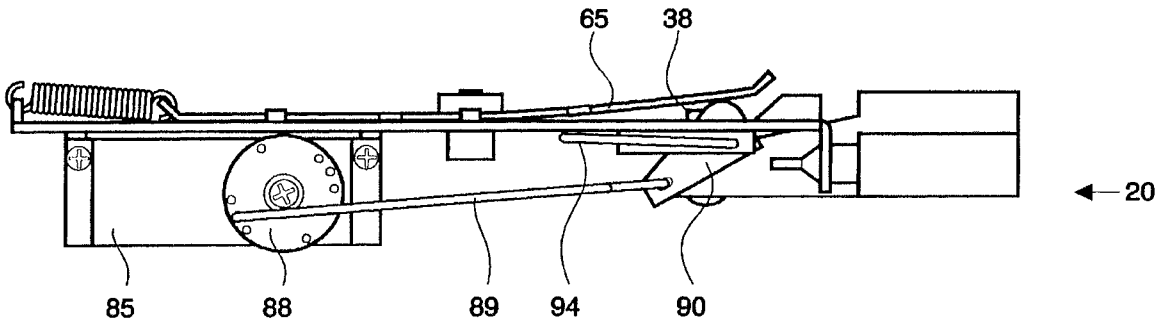
FIG. 6 shows a side view of the latch mechanism wherein the latchable component is in the process of being automatically unlatched from the latching component.

A second method of unlatching the latch mechanism, which for door hold open devices is accomplished automatically, is described with particular reference to FIG. 6. While annular extension 38 is engaged by latching aperture 69, latch plate 65 is disposed in its longitudinal latching position. Upon the appropriate signal, servomotor 85 is activated and rotates drive disc 88, thereby drawing actuator rod 89 rearward. As pivoting cam 90 is attached at its lower end to rod 89, cam 90 is forced to pivot about axle 94. The camming surface of pivoting cam 90 contacts the underside of latch plate 65, bending upward the forward portion, including latching aperture 69, of latch plate 65. Latch plate 65 does not appreciably longitudinally slide during this procedure but merely is bent upward. The camming surface of cam 90 is structured to shift latching aperture 69 upward a sufficient distance to disengage it from annular extension 38 and thereby unlatch the latchable component 20 and latching component 50. Only when servomotor 85 is reversed to counterrotate drive disc 88 is pivoting cam 90 returned to its ready position, whereby latch plate 65 is lowered to its planar ready configuration.

Figure 7:
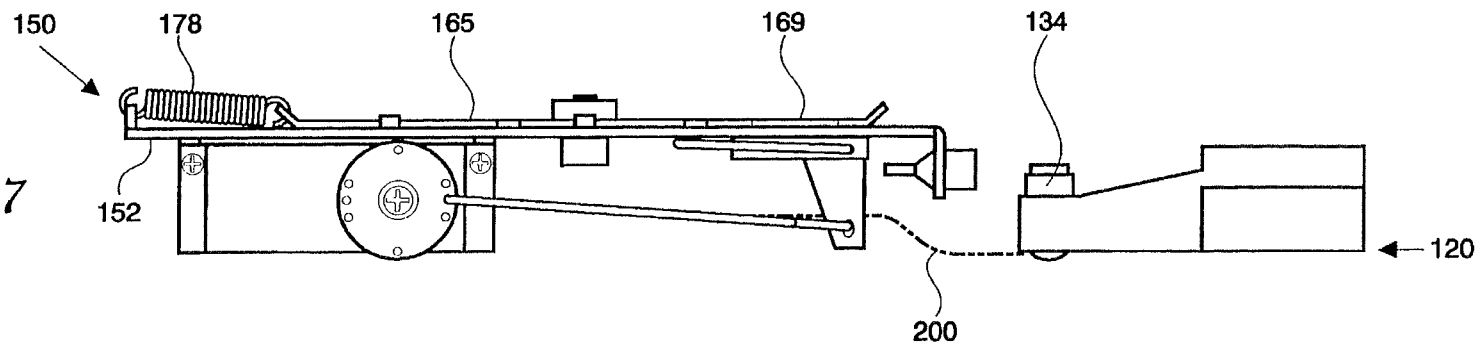
FIG. 7 shows a diagrammatic side view of another embodiment of the latch mechanism of the present invention, wherein the latchable component and latching component are in an unlatched condition.

In addition to the embodiment described above in association with FIGS. 1–6, an alternate embodiment within the scope of the present invention is diagrammatically shown in FIG. 7. The fundamental difference between the embodiment of FIG. 7 and the embodiment of FIGS. 1–6 relates to the ramp mechanism used to shift apart the latch elements of the latch mechanism components. In particular, the ramped mechanism is constructed as part of the track passageways rather than being constructed as part of the frame plate. Referring to FIG. 7, latchable component 120 is slidable along track 200. A portion of track 200 is abstractly shown as a dotted line, and this track portion parallels the travel path of the latchable element of component 120. Latchable component 120 may be identically structured to latchable component 20. Latching component 150 includes a leaf spring latch plate 165 slidably mounted to a frame plate 152, which is fixedly connected to track 200. Similar to the embodiments of FIGS. 1–6, latch plate 165 is coupled to frame plate 152 by means of springs 178, which bias latch plate 165 to a latching position. Latch plate 165 includes a latching aperture 169, structured similar to latching aperture 69, sized to receive pin 134. A cam mechanism similar to that of the embodiment of FIGS. 1–5 for automatic release of latchable component 120 may also be employed.

The process of latching together latchable component 120 and latching component 150 begins by forcing component 120 to the left in FIG. 7. As component 120 approaches component 150, a ramped portion of the guide passageways of track 200 causes pin 134 to be driven upward toward latching component 150. Latch plate 165 is positioned relative to the track ramped portion such that pin 134 first contacts the underside of latch plate 165 at a location forward of latching aperture 169. As latchable component 120 and therefore pin 134 continues to the left, latch plate 165 is bent upward until pin 134 inserts into latching aperture 169, at which time latch plate 165 returns to its planar orientation capturing pin 134 and thereby latching together components 120, 150.

Manual unlatching is initiated by pulling latchable component 120 to the right. Similar to the unlatching process described with reference to the embodiment of FIGS. 1–5, latch plate 165 is consequently pulled to the right due to its engagement with pin 134. When latchable component 120 has been moved sufficiently far to the right, pin 134 shifts downward due to the encountering of the ramped track portion by the latchable component slide block. When pin 134 has shifted downwardly enough to be clear of latching aperture 169, latch plate 165 is returned to its latching position by springs 178, and latchable component 120 is unlatched and free to slide along track 200.

Figure 8:
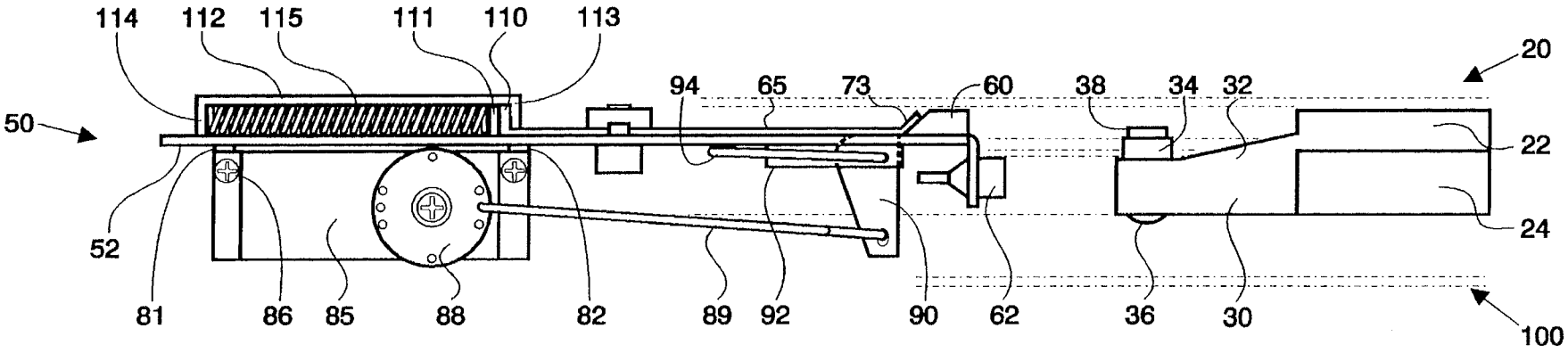
FIG. 8 shows a side view of a third embodiment of the latch mechanism of the present invention, wherein the latching component includes compression springs biasing the latching component toward the latched condition.

Referring now to FIG. 8, there is shown a third embodiment of the latching mechanism of the present invention, wherein the latching component includes compression springs biasing the latching component toward the latched position. In this embodiment, springs are not directly connected to latch plate 65 as is the embodiments of FIGS. 1–6. Rather, latch plate 65 includes upwardly extending flange 110 at the rearward end of latch plate 65. Extending upward from frame plate 52 is flange 111 which is, in this embodiment, wider than the width of latch plate 65. Flange 111 of frame plate 52 prevents latch plate 65 from sliding rearward beyond flange 111. Latching component 50 also includes cover plate 112 having downwardly extending front flange 113 for placement over the front edge of flange 110 of latch plate 65, and downwardly extending rear flange 114 slidably contacting frame plate 52.

Housed within cover plate 112 and extending between rear flange 114 of cover plate 112 and flange 110 of frame plate 52 are compression springs 115. Cover plate 112 may be kept in place with regard to the contact of flanges 114 and 113 with frame plate 52 and latch plate 65 by means well known in the art, such as the use of the latching mechanism's housing (not shown) slidably contacting the top of cover plate 112. Compression springs 115 place a rearward force on cover plate 112 which in turn biases latch plate 65 toward flange 111 of frame plate 52. In this manner, latch plate 65 is biased toward the latched position.

When latching component 50 is automatically or manually unlatched from a latched position in manners previously described herein, movement of latch plate 65 in the forward direction causes greater compression springs 115 and allows cover plate 112 to move forward with latch plate 65. As in the embodiment of FIGS. 1–5, springs 115 thus return cover plate 112 and latch plate 65 to its ready latching position from the unlatching position after release of annual extension 38.

It will be appreciated by those of skill in the art that the use of compression springs 115 to bias latch plate toward its unlatched position may be advantageous over the use of coil springs 78 of the embodiment of FIGS. 1–5 as compression springs are generally more durable than coiled springs over prolonged periods of usage. Yet, either the embodiment of FIGS. 1–5 or the embodiment of FIG. 8 are considered to be within the scope of the invention.

Figure 9A:
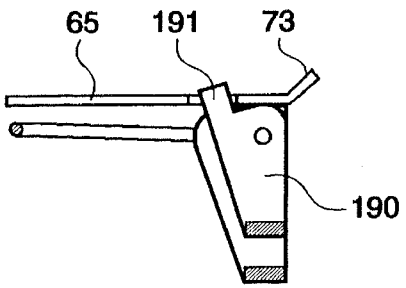
FIGS. 9A and 9B show a side view and end view, respectively, of another embodiment of the latching component of the present invention wherein the latching component includes a manually activated cam serving as one embodiment of the ramping mechanism.
Figure 9B:
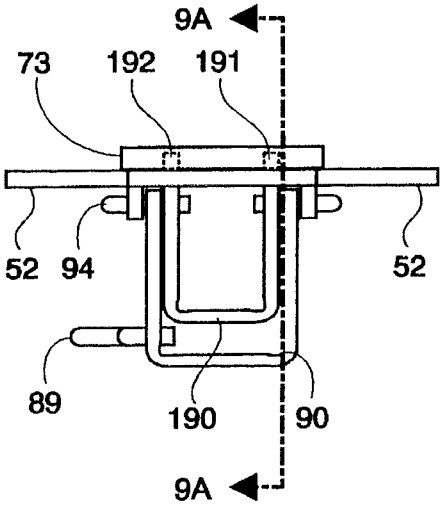

FIGS. 9A and 9B show a side view and an end view, respectively, of a third embodiment of the invention wherein the latching mechanism includes a manually activated cam serving as one embodiment of the ramping mechanism of the latching mechanism. In the embodiment of FIGS. 9A–9B, frame plate 52 does not include ramped shaped members 60 for ramping upwardly angled lip 73 of latch plate 65 to engage or disengage latchable component 20. Rather, the means for ramping latch plate 65 includes pivotable, manually-activated cam 190. Manually-activated cam 190 pivots about the same axis of electrically-activated cam 90, namely, cams 190 and 90 rotate about axle 94. Manually actuated cam 190 includes first and second tabs 191 and 192, each extending through an aperture in a latch plate 65.

It will be appreciated by those of skill in the art that engagement of manually actuated cam 190, as by latchable component 20, causes cam 190 to rotate to thereby raise and lower angled lip 73 of latch plate 65. It will also be appreciated that, in this embodiment, the shape of angled lip 73 of latch plate 65 is only necessary to encourage the forward end of latch plate 65 to flex during insertion of latchable component 20. If pin 34 of latchable component 20 was beveled, the forward end of latch plate 65 need not be formed with an angled lip as shown.

Figure 10A:
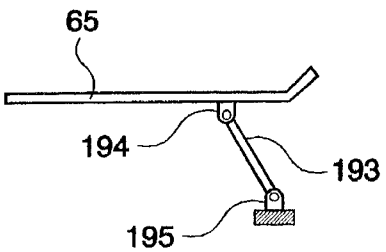
FIGS. 10A and 10B show side views of another embodiment of the ramping mechanism of the latching component in unramped and ramped positions, respectively, wherein the ramping mechanism includes a rocking link.
Figure 10B:
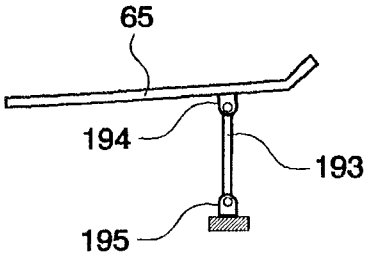

Referring now to FIGS. 10A and 10B, there are shown side view of a third embodiment of the ramping mechanism of the latching mechanism of the present invention. In FIG. 10A, latch plate 65 is unramped while in FIG. 10B, latch plate 65 is ramped in preparation for engagement or disengagement with the latching component of the present invention. The ramping mechanism includes rocking link 193 pivotally connected to latch plate 65 at first pivot 194 and to a surface, such as the frame for latching component 50, at second pivot 195. As latch plate 65 moves toward the unlatched position, rocking pin 173 causes latch plate 65 to be ramped at an angle near the forward end of latch plate 65.

It will be appreciated by those of skill in the art that many more embodiments of the ramping mechanism may be used for the latching component of the present invention. The three embodiments of FIGS. 1–5, FIGS. 9A–9B and FIGS. 10A–10B are merely illustrations. Other configurations are contemplated to be within the scope of the invention. For example, ball bearings may be placed near the forward end of latch plate 65 such that when latch plate 65 moves forward, the forward end of latch plate 65 is elevated over the ball bearings.

While this invention has been described as having a number of preferred designs, the present invention can be further modified within the spirit and scope of this disclosure. For instance, latching member 65 need not be plate shaped in order to function properly, but rather may be any number of recognized or undefined shapes capable of shifting relative to the latchable component to release or unlatch that component. While an aperture extending entirely through the latch member is shown as the latching element, a recess in the plate providing a surface which engages the latched pin is also acceptable. Moreover, although only one shape of the projecting pin 34 and the receiving aperture are shown, other complementary shapes which engage one another are envisioned. In addition, the projecting portion of the latch mechanism could readily be provided on the sliding latch plate with a concomitant substitution of a pin receiving element on the slide block. Also, the description herein with respect to automatic and manual are merely descriptive of the preferable manner in which the unlatching procedures are implemented. A situation wherein automatic unlatching involves sliding the latch plate into contact with the ramped members, or wherein manual unlatching involves operation of the camming mechanism, is within the scope of the present invention. Furthermore, frame plate angled lip 73 could be replaced with an appropriately sized and positioned angled surface on the rearward end of annular extension 38 to facilitate the physical latching process. Also, as stated and illustrated herein, the ramping means or mechanism of the invention may be embodied by a plurality of configurations which allow the latching component to release or accept the latched component. The "ramping" mechanism may be an element of the latching component, the latched component, or means external to those components, such as the shape of the track as illustrated in association with FIG. 7 herein. Therefore, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A latch mechanism comprising:

a first latch member including a first latch element;

a second latch member comprising a leaf spring and including a second latch element, said second latch member being movable in a first direction from a latching position to an unlatching position, said second latch element cooperatively structured with said first latch element to be engageable therewith, whereby said first and second latch members are latched together when said second latch member is disposed in said latching position and said first latch element engages said second latch element;

ramp means separate from the first and second latch members for bending said leaf spring of said second latch member in a second direction relative to said first latch member when said second latch member moves in said first direction to said unlatching position while said first and second latch elements are engaged, whereby said first latch element and said second latch element disengage to unlatch the first and second latch members; and at least one bias means returning said second latch member from said unlatching position to said latching position.

2. The latch mechanism of claim 1 wherein said at least one bias means comprises at least one coil spring.

3. The latch mechanism of claim 1 wherein said at least one bias means biases said second latch member toward said latched position.

4. The latch mechanism of claim 1 wherein said second latch member comprises a plate.

5. The latch mechanism of claim 4 wherein said first latch member comprises a pin projecting in said second direction, wherein said first latch element comprises a surface of said projecting pin, and wherein said second latch element comprises a surface of an aperture in said plate.

6. The latch mechanism of claim 1 wherein said second latch member comprises an angled lip portion for contacting said first latch member during movement of said first latch member toward said second latch member for latching.

7. The latch mechanism of claim 1 further comprising means for moving said second latch member in said second direction to disengage said first latch element from said second latch element.

8. The latch mechanism of claim 7 wherein said moving means comprises a servomotor operatively connected to a pivoting cam.

9. The latch mechanism of claim 1 wherein said first latch member is slidable along a track.

10. The latch mechanism of claim 9 wherein said track comprises said ramp means.

11. A latch mechanism comprising:

latchable member including a latchable element projecting therefrom;

a latching member comprising a leaf spring and including a latching element, said latching member being movable from a latching position toward an unlatching position, said latching element cooperatively structured with said latchable element to achieve a latching engagement therewith when said latching member is disposed in said latching position and said latching element engages said latchable element;

a least one ramp member separate from the latching member and latchable element structured and arranged to bend said leaf spring and to direct said latching element out of said latching engagement with said latchable element when said latching member is moved from said latching position toward said unlatching position; and at least one bias means for returning said latching member from said unlatching position to said latching position.

12. The latch mechanism of claim 11 further comprising a track, wherein at least one of said latchable member and said latching member is slidable relative to the other of said latchable member and said latching member along said track.

13. The latch mechanism of claim 11 wherein said at least one bias means comprises a spring biased to deflection, and wherein said directing of said latching element by said at least one ramp member comprises bending of said latching member away from said latchable member.

14. The latch mechanism of claim 11 wherein said at least one bias means comprises at least one coil spring.

15. The latch mechanism of claim 11 wherein said latching member comprises a substantially fiat plate and said latching element comprises a surface of an aperture extending through said plate.

16. The latch mechanism of claim 15 wherein said plate comprises an angled lip portion for contacting said latchable member during movement of said latchable member toward said latching member for latching.

17. The latch mechanism of claim 11 further comprising means for moving said latching member to disengage said latchable element from said latching element.

18. A latch mechanism for releasably coupling a first object and a second object, said latch mechanism comprising:

a latchable component connected to the first object, and a latching component connected to the second object;

said latchable component comprising, a projection extending in a first direction;

said latching component comprising, a latching member comprising a leaf spring having a forward end and a projection receiving element formed therein, said latching member being slidable in a second direction from a latching position to an unlatching position, said projection receiving element cooperatively structured with said projection to be engageable therewith, wherein said latching component and said latchable component are latched together when said latching member is disposed in said latching position and said projection and said projection receiving element are engaged, and at least one bias means for returning said latch member from said unlatching position to said latching position; and ramp means separate from the latchable component and the latching component for contacting said forward end of said latching member when said latching member slides in said second direction from said latching position to said unlatching position, said ramp means structured to bend said latching member in said first direction such that said projection disengages from said projection receiving element, whereby said latchable component and said latching component are unlatched.

19. The latch mechanism of claim 18 further comprising a track, and wherein at least one of said latchable component and said latching component is slidable relative to the other of said latchable component and said latching component along said track.

20. The latch mechanism of claim 18 further comprising means for moving said latching member in said first direction to disengage said projection from said projection receiving element.

21. A latch mechanism comprising:

a first latch member, said first latch member including a projection extending therefrom;

a second latch member, said second latch member comprising a leaf spring including a projection receiving element;

said first latch member being longitudinally movable between a latched position wherein said projection and said projection receiving element are latchingly engaged, and an unlatched position;

at least one bias means for returning said second latch member from said unlatching position to said latching position; and ramp means separate from the first and second latch members for bending said projection receiving element in an angular direction relative to the direction of movement of said first latch member upon movement of said first latch member from the latched position toward the unlatched position, said ramp means being configured to displace said projection receiving element a distance sufficient to disengage said projection and projection receiving element upon said movement of said first latch member, thereby unlatching said first and second latch members.

22. A latch mechanism comprising:

a first latch member, said first latch member including a projection extending therefrom;

a second latch member, said second latch member comprising a leaf spring having forward and rearward ends, a projection receiving element disposed at said forward end of said leaf spring, and a frame plate having a longitudinal axis and having lugs formed therein for receipt of said rearward end of said leaf spring such that said leaf spring is oriented along said longitudinal axis of said frame plate, said rearward end of said leaf spring operatively connected to said frame plate such that said leaf spring is movable between a first position and a second position;

said first latch member being longitudinally movable between a latched position wherein said projection and said projection receiving element are latchingly engaged, and an unlatched position; and ramp means separate from the first and second latch members for bending said projection receiving element in an angular direction relative to the direction of movement of said first latch member upon movement of said first latch member from the latched position toward the unlatch position, said ramp means being configured to displace said projection receiving element a distance sufficient to disengage said projection and projection receiving element upon said movement of said first latch member, thereby unlatching said first and second latch members.

* * * * *